United States Patent [19]

Treffner et al.

[11] 4,222,299

[45] Sep. 16, 1980

[54] MULTI-BLADED CUTTING APPARATUS

[76] Inventors: Peter Treffner; Charles Treffner, both of 43 Yangoora Rd., Belmore, N.S.W. 2192, Australia

[21] Appl. No.: 529

[22] Filed: Jan. 2, 1979

[30] Foreign Application Priority Data

Jan. 9, 1978 [AU] Australia ..... PD2980

[51] Int. Cl.[3] ..... B26D 4/16; B26F 3/12

[52] U.S. Cl. ..... 83/870; 83/171; 83/582; 83/651.1; 83/748; 83/751; 83/785; 83/862

[58] Field of Search ..... 83/171, 16, 748, 751, 83/785, 753, 651.1, 870, 862, 582

[56] References Cited

U.S. PATENT DOCUMENTS

| | | | |
|---|---|---|---|
| 2,528,853 | 11/1950 | Brustowsky | 83/751 |
| 3,786,701 | 1/1974 | Ludwig | 83/651.1 X |
| 3,830,123 | 8/1974 | Wilgus | 83/651.1 X |
| 3,929,048 | 12/1975 | McGehee | 83/751 |
| 4,018,116 | 4/1977 | Treffner et al. | 83/171 X |

*Primary Examiner*—Frank T. Yost

*Attorney, Agent, or Firm*—Stevens, Davis, Miller & Mosher

[57] ABSTRACT

This invention relates to gang saws and other cutting apparatus having oscillating cutters for cutting workpieces into slices. The invention provides apparatus, having two elongate spaced apart cutter supports which are driven to oscillate 180° out of phase with each other. Two sets of cutters are connected to the supports. For a suitable workpiece the cutters may be of a hot wire type. Each cutter of one set is connected to the first support by a resiliently extensible connector such as a spring and to the second support by a non-extensible connection. Each cutter of the other set is connected to the second support by a resiliently extensible connector and to the first support by a non extensible connection. Desirably the cutters of one set alternate with cutters of the other and all cutters are coplanar. Movement of cutters of each set in opposite directions tends to cancel the local influence of cutters on the workpiece. Moreover whole frames of cutters may be removed and replaced, facilitating reprogramming of the apparatus in terms of spacings between cutters.

13 Claims, 9 Drawing Figures

MULTI-BLADED CUTTING APPARATUS

This invention relates to gang saws and other cutting apparatus having a plurality of spaced apart oscillating cutters for cutting workpieces, such as for example, rods, slabs and billets, into slices.

Simple types of such apparatus usually comprise a plurality of elongate cutters held rigidly in an oscillating frame and means to move the workpiece through the cutters as they oscillate or alternatively to move the frame and cutters longitudinally of the workpiece. Difficulties are experienced with such simple forms of apparatus in that considerable restraint has to be applied to the workpiece to prevent it oscillating with the cutters.

When cutting some materials, for example, foamed plastics materials, which are relatively fragile it is not possible to apply the necessary restraint to the workpiece.

In such instances and for the superior cutting of other materials as well, it has been proposed to use two sets of cutters in two frames oscillating 180° out of phase so that the forces in one direction applied by one set of cutters to the workpiece are counter-balanced by forces operating in the other direction by the other set of cutters.

However, the use of two such sets of cutters is itself objectionable for a number of reasons; for example, it is not possible to arrange readily for each set of cutters to be in the one plane and thus out of balance forces are applied to the workpiece as it enters and leaves the cutting zone as for a short distance it is then in contact with only one or other of the cutters. In attempts to overcome that difficulty it has been proposed to have the respective cutters in inclined planes which intersect at a common centreline of the two sets of cutters. The aforesaid centreline is then arranged to coincide with a centre plane of the workpiece. This if correctly set does eliminate the problem of oscillating loads being applied to the workpiece, however it does require considerable precision in setting the cutters in the frames and also in setting the workpiece relative to the frames. Also, all expedients involving the use of two frames introduce mechanical complexities simply in providing for the two frames and for their concerted but out of phase oscillation.

With the foregoing in mind the present invention was devised to simplify those mechanical complexities and at the same time ensure that the workpiece is not subjected to out of balance forces.

According to one aspect the invention consists in a cutting apparatus comprising:

two elongate spaced apart cutter supports;

drive means to cause said cutter supports to oscillate 180° out of phase to each other, a plurality of elongate cutters of which substantially half belong to a first set and the remainder to a second set;

resiliently extensible connector means connecting one end of each cutter of said first set to one cutter support and one end of each cutter of said second set to the other cutter support; and non-extensible connector means connecting the other end of each cutter of said first set to said other cutter support and said other end of each cutter of said second set to said one cutter support.

It will be understood that while said plurality is desirably an even number of cutters, it may be an odd number. In that case it is not possible to arrange that exactly half the cutters belong to each set. The term "substantially half" therefore embraces the case in which said plurality comprizes for example three cutters of which two belong to one set and one belongs to the other.

It will also be appreciated that there is a latitude in the extent to which the number of cutters belonging to each set need be similar. As the total number of cutters in the plurality increases, the disparity in the number belonging to each set may be greater than 1.

For example, an array of twenty cutters should consist preferably of ten belonging to each set but sets of nine and eleven or less preferably eight and twelve may give acceptable results depending on spacing and the nature and shape of the workpiece.

In preferred embodiments of the invention a vertical array of cutters and, or alternatively, a horizontal array of cutters may act on one workpiece simultaneously.

Also, in preferred embodiments, means are provided which facilitate the mounting or demounting of any individual cutter of an array, and hence permit adjustment of spacing between cutters, without necessity for time consuming realignment of the apparatus as a whole or of each new workpiece.

In addition, in more highly preferred embodiments, a whole array of cutters can be readily substituted as a unit for another array. Arrays can readily be arranged to have differing spacing between cutters so that the apparatus can be programmed, for example, to cut slabs of a first thickness from a first workpiece and then reprogrammed by changing arrays to cut slabs of a second thickness from a second workpiece, the change being accomplished in a very short time in comparison with the time required to make such a change with prior apparatus.

An embodiment of the invention will now be described with reference to the accompanying drawings in which.

Figure 1:
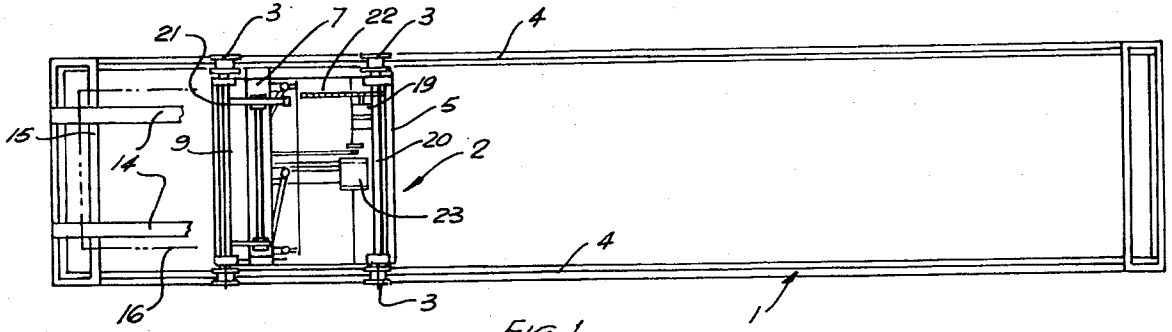
FIG. 1 is a simplified plan view of the embodiment.
Figure 3:
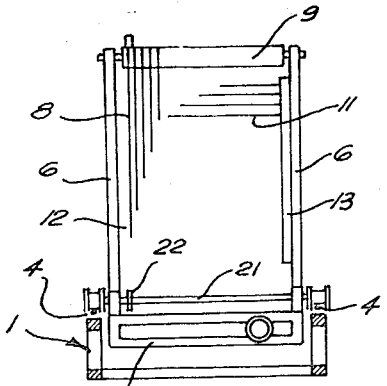
FIG. 3 is an end view taken on line 3—3 of FIG. 2 of the apparatus.
Figure 2:
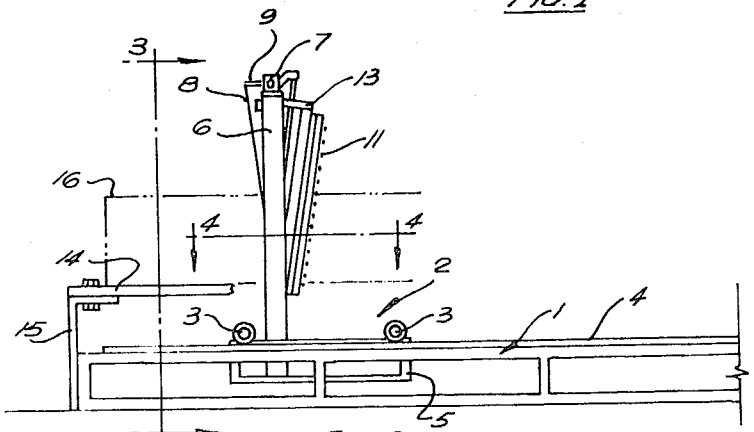
FIG. 2 is a part side elevation of the apparatus shown in FIG. 1.

With reference to FIGS. 1, 2 and 3 there is shown a bed 1 along which a trolley 2 is adapted to travel by means of wheels 3 running along two rails 4.

Trolley 2 consists of a base frame 5 bearing two columns 6 connected by a top cross member 7.

A horizontal array 11 of cutters, which in the present apparatus are of a hot wire type, is connected between left and right cutter support assemblies 12 and 13. In addition, or alternatively, a vertical array 8 of similar cutters is connected between upper cutter support assembly 9 and a lower cutter support assembly 10 (not visible in FIGS. 1 to 3). The cutting wires and their means of support and attachment will be described in more detail hereinafter.

A set of work support bars 14 are bolted by means of fixed end brackets 15 to bed 1 to support a workpiece or pieces 16. The workpiece may be of any size, limited only by the effective width and height of trolley 2 and the length of bed 1.

Figure 4:
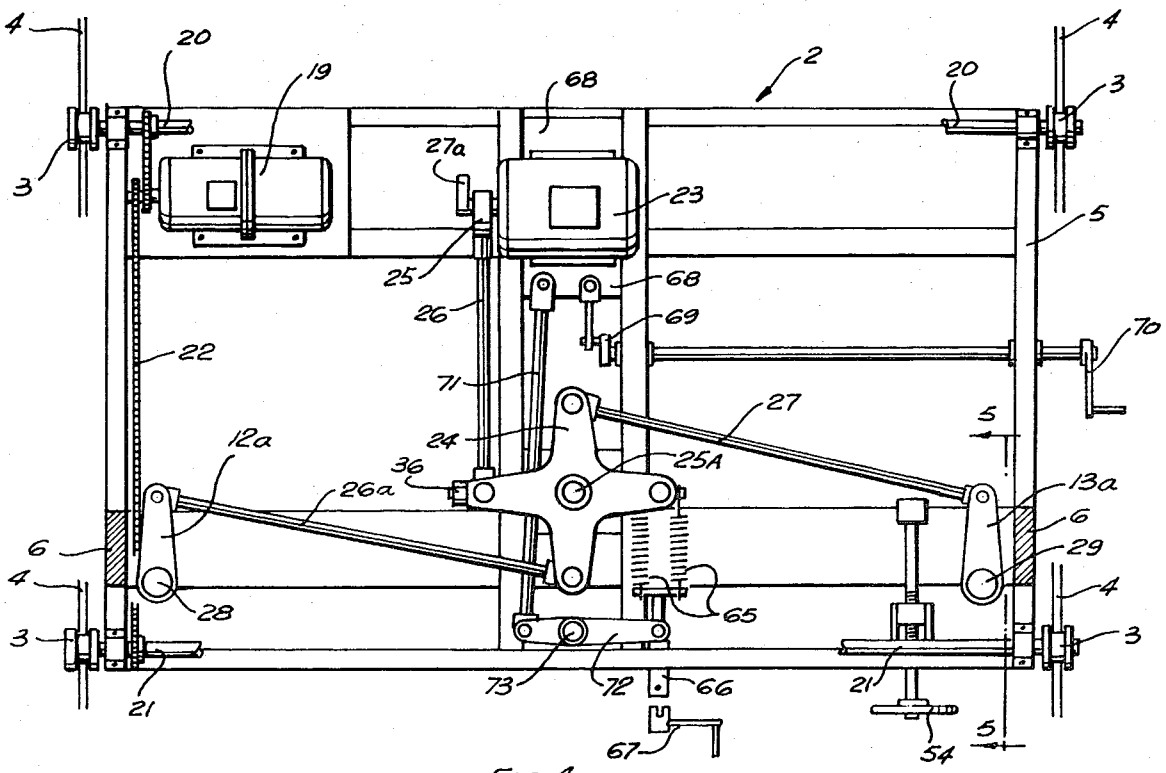
FIG. 4 is a plan view taken on line 4—4 of FIG. 2 showing in greater detail the trolley which is a part of the apparatus.

With reference to FIG. 4 a geared motor 19 mounted to trolley 2 drives wheel axles 20 and 21 by a sprocket and chain system 22. Since trolley wheels 3 are rigidly fixed in pairs to axle shafts 20 and 21, the four wheels operate together to drive trolley 2 longitudinally of bed 1. The speed of motor 19 can be varied electrically as required and hence a trolley speed may be selected suitable to the cutting characteristics of the cutting wires employed and the material to be cut.

A second motor 23 mounted to trolley 2 drives a four armed rocker 24 by means of an eccentric 25 and a connecting rod 26 one end of which is attached to a first arm of rocker 24. A balance weight 27*a* mounted to eccentric 25 is provided to balance crank action of connecting rod 26 and rocker 24.

Rocker 24 oscillates about its axis 25A in the order of 10° to each side of its dead centre, causing left and right push rods 26*a* and 27 pivotally connected respectively to second and fourth arms of rocker 24 to move axially in opposite directions. The other end of push rods 26*a* and 27 are pivotally connected to vertical crank arms 12*a* and 13*a* respectively and cause their pivotal oscillation about the axis of vertical rocker shafts 28 and 29 to which the rocker arms are fixedly mounted. Shafts 28 and 29 therefore oscillate in opposite directions about their own axes and when left crank arm 12*a* turns clockwise right crank arm 13*a* turns anti-clockwise. This oscillation is also in the order of 10° to each side of normal dead centre.

Figure 9:
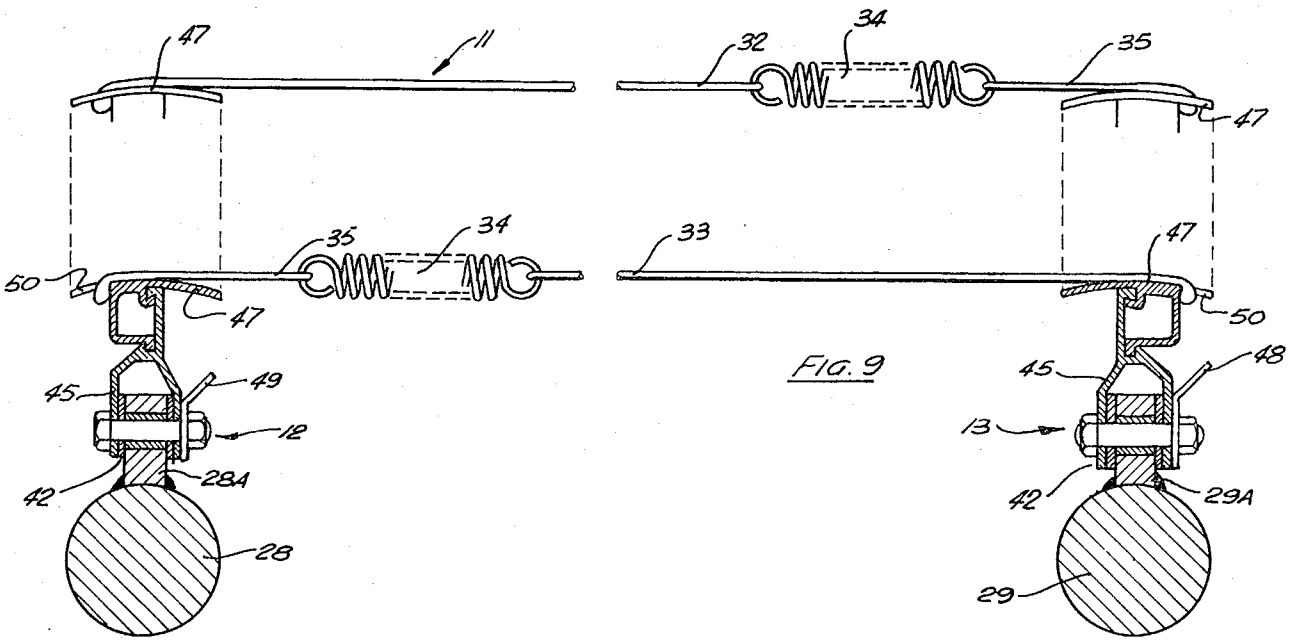
FIG. 9 is a sectional plan view of horizontal cutters of the apparatus and associated cutter support assemblies.

Left and right cutter support assemblies 12 and 13 are shown in more detail in FIG. 9. Left and right crank arms 12*a* and 13*a* are fixedly mounted to rocker shafts 28 and 29. Mount extrusions 45 are mechanically connected to vanes 28A and 29A on the shafts 28 and 29 respectively and are electrically insulated therefrom by insulators 42. Terminals 48 and 49 provide electrical connection to mount extrusions 45.

Figure 8:
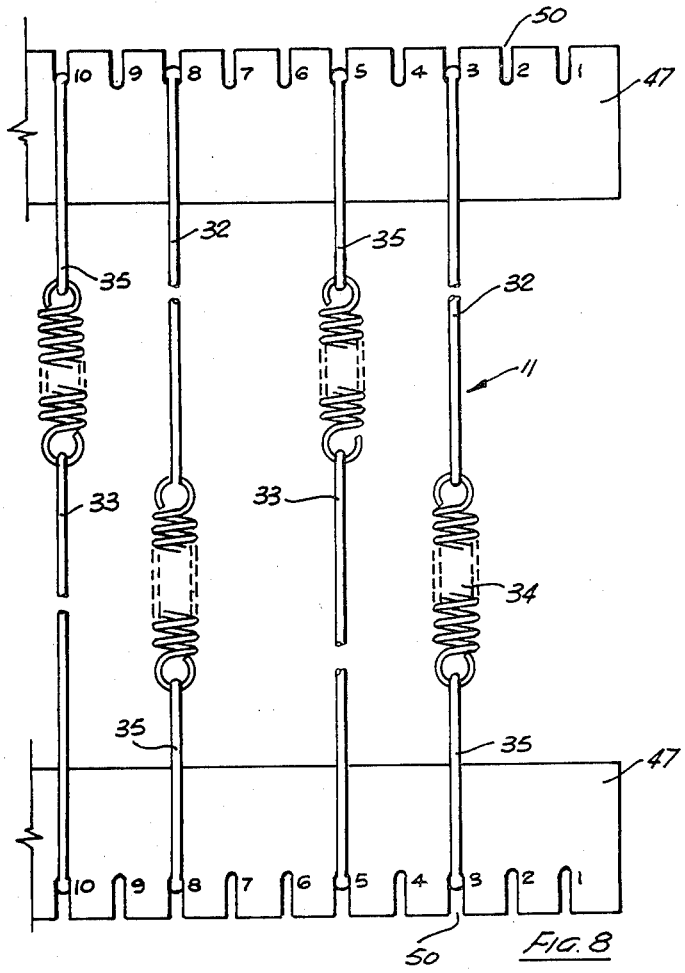
FIG. 8 is a partial front view of program bars of the apparatus with cutter assemblies mounted thereto.

Left and right program bars 47 are aluminium extrusions which are mounted to, and electrically connected with, mount extrusions 45 by inter-engagement. The horizontal array 11 of cutter assemblies is strung between the left and right program bars 47. With reference to FIGS. 8 and 9 each individual cutter is a wire 32 or 33 and is connected to a pair of program bars 47 as part of a cutter assembly comprising the cutter wire itself, a spring 34, and to a short wire trace 35 connected each to each. In each case the cutter wire spans the majority of the distance between program bars 47.

The free end of trace 35, and of each cutter wire 32 or 33, is adapted for engagement under tension with slots 50 of program bars 47 by means of a knot or tab at or near the end of each cutter wire and of each trace.

Thus each cutter wire 32 or 33 is connected by the resiliently extensible spring 34 via trace 35 to one of a pair of cutter support assemblies and by non extensible means to the other cutter support assembly.

Cutter wires 32 and 33 are conventional hot wire type cutting wires and are identical except in respect of the orientation in which they are mounted.

Horizontal array 11 comprises a plurality of cutter assemblies some of which are strung in opposite sense to the others. Thus while wires 32 belong to a set directly engaged with the left program bar 47, wires 33 belong to a set directly engaged with right program bar 47.

In the present embodiment horizontal array 11 may comprise 10 or more wires connected to the left program bar 47 and usually the same number connected to the right program bar. It is highly preferable that alternate cutter assemblies are mounted in opposite sense so that for example even numbered wires are connected to the left program bar while odd numbered wires are connected to the right program bar.

When cutter support assembly 12 is driven anti-clockwise by motor 23, cutter support assembly 13 turns clockwise as previously described. The cutter assemblies of horizontal array 11 are thus stretched causing springs 34 to elongate and causing cutter wires 32 attached to left program bar 47 to move to the left while cutter wires 33 attached to right program bar 47 move to the right. Similarly, when cutter support assemblies 12 and 13 move inwardly towards each other, springs 34 contract, so that cutters 32 move to the right while cutters 33 move to the left.

Movement of alternate cutters in opposite direction cancels local influence of cutters on workpiece 16.

Figure 7:
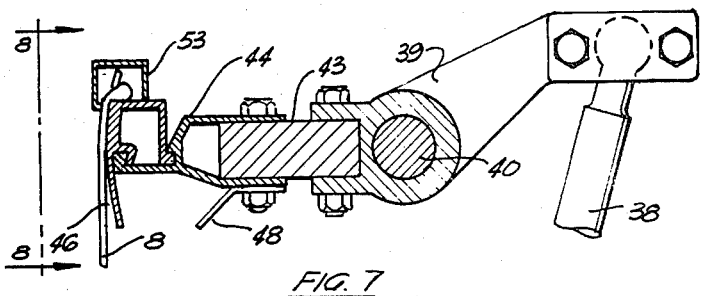
FIG. 7 shows in more detail the upper cutter support assembly part shown in FIG. 6.

The individual cutter assemblies of vertical array 8 are identical to those of horizontal array 11 each consisting of a cutting wire, spring and trace. However the length of cutters in array 11 may differ from those of array 8 depending on the dimensions of the trolley frame. The cutter assemblies of array 8 are similarly strung in alternate sense between upper and lower program bars 46, which are extrusions similar to horizontal program bars 47, and are mounted to upper and lower cutter support assemblies 9 and 10 by means similar to those described for mounting left and right program bars 47. Thus with reference to FIG. 7 the upper cutter support assembly 9 comprises upper program bar extrusion 46 interengaging with mount extrusion 44 insulated by means 43 from rocker shaft 40 and connectable by terminals 48 to an electricity source.

Figure 6:
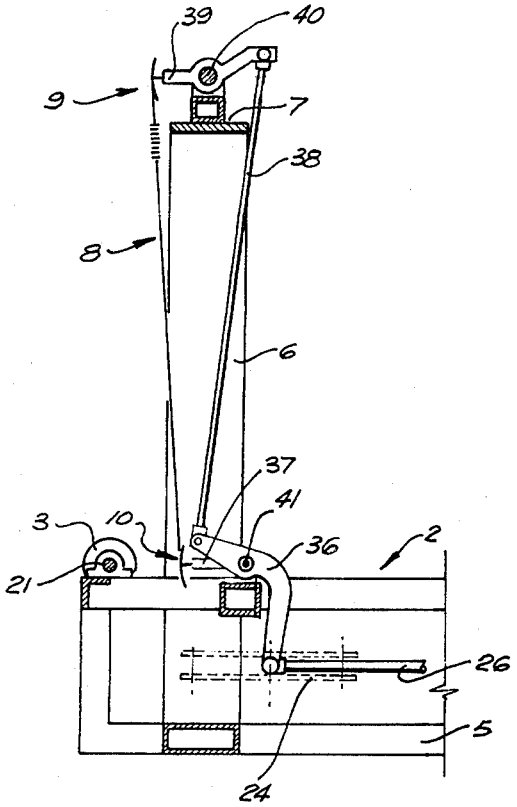
FIG. 6 is a part section on the line 6—6 similar to FIG. 5 but showing in greater detail those elements related to the vertical cutters of the apparatus.

The lower cutter support assembly 10 attached to lower rocker arm 37 is similar. With reference to FIGS. 4 and 6 upper and lower rocker arms 37 and 39 are mounted on upper and lower rocker shafts 41 and 40 and are driven in oscillatory motion similar to that of vertical shafts 28 and 29 by the same motor 23. In this case connecting rod 26 operates bell crank 36 by pivotal connection with one end thereof. Bell crank 36 is mounted on, and oscillates, lower rocker shaft 41. The other end of bell crank 36 is linked with upper cutter support 39 by a vertical drag link 38. Thus alternate cutters of array 8 also move in opposing directions and also cancel out local influence on the workpiece.

The cutting wires of both vertical array 8 and horizontal array 11 may be heated by applying an electrical current through an input terminal 48 so that it is conducted through all wires 32 and 33 to an output terminal 49. The current and voltage may be varied externally so that sufficient current is applied to each wire to maintain a temperature compatible with the work to be cut and the cutting speed to be attained. An air circulatory system (not illustrated) is provided to dissipate unused heat generated in the wires. The program bars in the present embodiment are extruded aluminium sections (FIGS. 7 and 9) designed to clip into the support bars 44 and 45 for easy removal. Preferably slots 50 are numbered to facilitate alignment when inserting cutter assemblies, the elements of each assembly being permanently linked together. Cutting wire assemblies can therefore be inserted and removed from program bars by stretching springs 34 and the spacing between cutting wires readily altered.

Preferably a retaining bar 53 (FIG. 7) is provided to clip over cutter assemblies and slots 50 of program bars so as to hold the wires in position when a pair of program bars, together with an array of cutter assemblies connected thereto is removed from the apparatus. It is thus possible to preload a pair of program bars with an array in which each cutter assembly is spaced from each other to suit a particular job and merely to clip a new whole array into the program support extrusions 45 to have the apparatus ready to cut a new workpiece to different dimensions from a previous workpiece. Moreover a particular array can be stored for use at a later date thus eliminating the need to reprogram arrays to suit each job.

Figure 5:
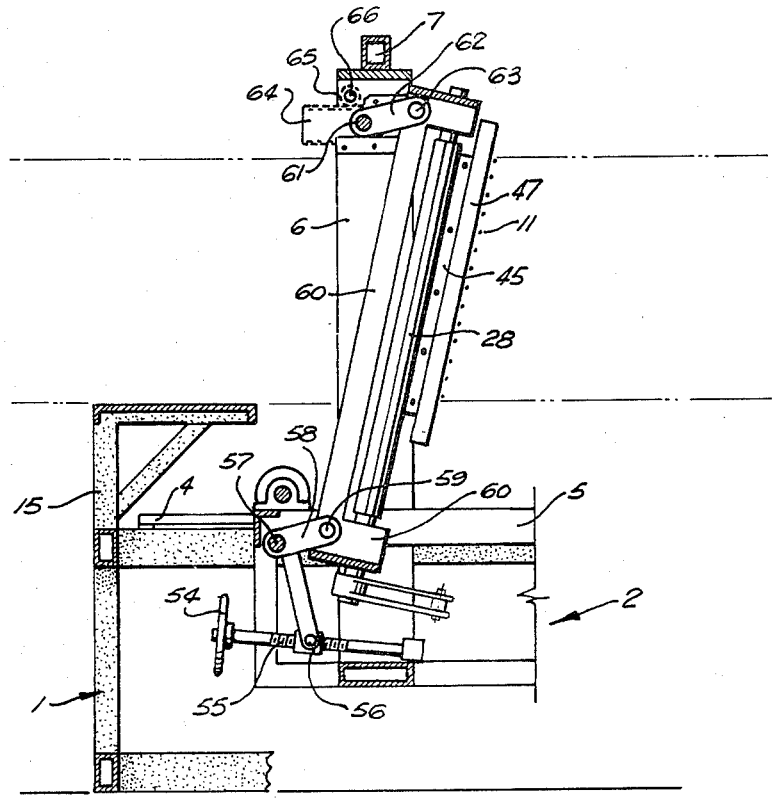
FIG. 5 is a sectional elevation on line 5—5 of FIG. 4 showing in greater detail those elements related to the horizontal cutters of the apparatus.

FIG. 5 shows how the horizontal wires may be adjusted upwardly or downwardly. A hand-wheel 54 turns a screwed shaft 55 moving a threaded nut 56 backwardly or forwardly about lower axis shaft 57. This shaft runs across the width of trolley 2 and carries two lower link pairs 58 which are in turn pin-connected at 59 to rocker vertical axis frames 60. The upper end of the left and right frame 60 are linked to the upper axis shaft 61 by means of two upper link pairs 62 and pins 63. Turning hand-wheel 54 therefore causes the whole horizontal wire rocker frame and frame assemblies to move upwards and downwards as required. The horizontal wires can be moved a very small amount by the vernier rack 64 and pinion 65. There are two sets of these verniers one of the left column 60 and one on right column 60 connected together by a vernier cross shaft 66. When cross shaft 66 is turned by means of a tommy bar (not shown) and left and right pinions 65 cause the left and right racks 64 to move in or out. This movement is transferred to the vertical axis frames 60 via links 62 causing the whole horizontal wire and rocker mechanism to pivot about the lower axis pins 59, thus varying the true vertical pitch of the horizontal wires according to the angular setting of the wire assembly.

It will be recalled that springs 34 of cutter assemblies are tensioned by the drive force of motor 23 via the interlinkage system previously described and contract during part of the oscillatory cycle of the rocker shafts. When a multiplicity of cutter assemblies are in use this force can be a major factor in the drive system. Therefore, with reference to FIG. 4, lower springs 65 are provided on the third cross arm of rocker 24. Wire springs 34 tend to turn rocker 24 in an anti-clockwise direction. Lower springs 65 load it in a clockwise direction so that the system is in equilibrium at the dead-centre condition. The motor therefore only drives the out of balance condition between springs 65 and cutter springs 34. The balance springs 65 balance both the vertical and horizontal wire spring loads at the same time. The tension in the balance springs can be varied to suit the number of wires in use by means of adjusting nut 66 turned by crank handle 67. Rocker drive motor 23 is mounted on sliding bed 68 which is held in position by means of crank 69 and lever 70. In the normal drive mode the motor is held in an extreme upper position as illustrated in FIG. 4. When the system is at rest all wire springs and balance springs are in equilibrium but under tension.

When program bars and wires have to be moved for adjustment or reprogramming this tension must be released. Lever 70 is rotated 180° thus turning crank 69 allowing motor 23 and slide 68 to move inward (downward in FIG. 4). This in turn causes rocker 24 to turn anti-clockwise releasing compression in push rods **26*a* and 27 and so tension in wire springs 34. At the same time drag link 71 allows lever 72 to rotate anti-clockwise about its centre 73 thus releasing tension on balance springs 65**. All program bars and wires can then be lifted from the apparatus.

It will be understood that while the apparatus described above employs heated wires as cutters, an apparatus employing for example toothed blades as cutters could be similarly arranged.

The cutter support means need not be made to oscillate pivotally and those skilled in the art will appreciate that the two cutter support means may be driven for example in linear oscillation towards and apart from each other by other mechanical interlinkage arrangements.

In that case the cutter supports need not be linear. For example, the vertical cutters may be connected between two overlying "V" shaped cutter supports the cutting wires then not lying in one plane.

In all cases it is desirable that torque exerted by one set of cutters on the workpiece be balanced by a torque exerted by the other set of cutters and that the local influence of cutters in a region of the workpiece be substantially balanced.

Generally this is best achieved by arranging that alternate cutters belong to different sets. However depending on factors such as the uniformity of density of the workpiece and its cross-sectional shape, it may be desirable that two or more cutters from one set alternate with two or more cutters from other sets, or that other arrangements of cutters be employed.

We claim:

1. A cutting apparatus comprising:

two elongate spaced apart cutter supports;

drive means to cause said cutter supports to oscillate 180° out of phase to each other, a plurality of elongate cutters of which substantially half belong to a first set and the remainder to a second set;

resiliently extensible connector means connecting one end of each cutter of said first set to one cutter support and one end of each cutter of said second set to the other cutter support; and non-extensible connector means connectng the other end of each cutter of said first set to said other cutter support and said other end of each cutter of said second set to said one cutter support.

2. Apparatus according to claim 1 wherein a cutter of said first set is spaced between two cutters of said second set.

3. Apparatus according to claim 1 wherein a number of cutters of said first set are spaced between two cutters of said second set.

4. Apparatus according to claim 2 wherein a majority of cutters of said first set alternate with cutters of said second set.

5. Apparatus according to claim 3 wherein a number of cutters of said first set are spaced between two substantially corresponding numbers of cutters of said second set.

6. Apparatus according to any one of the preceding claims wherein said cutters are mutually parallel.

7. Apparatus according to any one of claims 1 to 5 wherein the cutters of both sets act in a plane.

8. Apparatus according to any one of claims 1 to 5 wherein said cutter supports oscillate about a support axis.

9. Apparatus according to any one of claims 1 to 5 wherein a said plurality of cutters is demountable from said apparatus as an array.

10. Apparatus according to any one of claims 1 to 5 wherein a said cutter is demountable from said cutter supports.

11. Apparatus according to any one of claims 1 to 5 wherein each a cutter is a wire.

12. Apparatus according to any one of claims 1 to 5 wherein a cutter is an electrically heated wire.

13. Apparatus according to any one of claims 1 to 5 wherein a said resiliently extensible connector means is a spring.

* * * * *